United States Patent [19]

Duchene

[11] 4,449,110

[45] May 15, 1984

[54] DEVICE FOR CHOCKING AN INVERTED TYPE CURRENT TRANSFORMER WHEN TRANSPORTED ON ITS SIDE

[75] Inventor: Jean C. Duchene, Le Bourget Du Lac, France

[73] Assignee: Alsthom-Atlantique, Paris, France

[21] Appl. No.: 409,806

[22] Filed: Aug. 20, 1982

[30] Foreign Application Priority Data

Sep. 17, 1981 [FR] France ..... 81 17547

[51] Int. Cl.[3] ..... H01F 27/02

[52] U.S. Cl. ..... 336/94; 336/65; 336/68; 336/100; 336/105

[58] Field of Search ..... 336/65, 68, 94, 100, 336/105

[56] References Cited

U.S. PATENT DOCUMENTS

| | | | |
|---|---|---|---|
| 1,219,300 | 3/1917 | Hall | 336/94 X |
| 3,175,174 | 3/1965 | Simmons | 336/100 X |
| 3,380,009 | 4/1968 | Miller | 336/94 X |

FOREIGN PATENT DOCUMENTS

| | | | |
|---|---|---|---|
| 2420325 | 11/1975 | Fed. Rep. of Germany | 336/100 |
| 2650501 | 11/1978 | Fed. Rep. of Germany | 336/65 |
| 497717 | 9/1919 | France . | |
| 1293745 | 3/1961 | France . | |
| 1293030 | 3/1961 | France . | |
| 997483 | 7/1965 | United Kingdom . | |

*Primary Examiner*—J. V. Truhe
*Assistant Examiner*—Susan Steward
*Attorney, Agent, or Firm*—Sughrue, Mion, Zinn, Macpeak & Seas

[57] ABSTRACT

A device for chocking an inverted type current transformer when transported on its side.

It comprises at least one jack (12) within the metal enclosure (1) but operable from outside the latter and disposed, during transportation of the transformer on its side, between the transport platform (36) and the magnetic core (8) of the current transformer to eliminate any cantilever loading.

5 Claims, 5 Drawing Figures

1
8
7
5
4
6
11
2
3

1
8
15
13
4
14
III
12
11
36
2
3

DEVICE FOR CHOCKING AN INVERTED TYPE CURRENT TRANSFORMER WHEN TRANSPORTED ON ITS SIDE

FIELD OF THE INVENTION

The present invention relates to inverted type current transformers for high and very high voltages and more particularly to chocking same during transportation on their side.

BACKGROUND OF THE INVENTION

An inverted type current transformer has its active part disposed in a metal enclosure disposed at the top of a column insulator. The magnetic core of the current transformer is of metal and toroidal in shape. It is attached to the metal base of the insulator through the intermediary of a hollow metal mast disposed within the column insulator. It carries the secondary winding or windings, the ends of which are brought out through the inside of the mask to bushes disposed on the base of the column insulator.

The primary of the current transformer is formed by a small number of turns wound around the magnetic core at a sufficient insulation distance. It is attached by its ends to the metal enclosure which is at the potential of one end. The metal enclosure and the column insulator are filled with a dielectric material, which may be a gas, for example, which insulates the primary of the current transformer which is at a high voltage from the secondaries and the core, within the enclosure. The column insulator maintains the metal enclosure, which is at the high voltage of the current transformer primary, at a sufficient distance from the ground to ensure its insulation by the air.

The mass of the magnetic core and the height of the column insulator as well as the insulation distances are proportional to the working voltage. Inverted type current transformers for working voltages of the order of 300 kV and above are of a height which exceeds the limits imposed for road and rail transport, and have a magnetic core weighing several hundred kilograms attached to the top of a metal mast several meters high. During transportation on the side, the mass of the magnetic core loads the end of the mast cantilever fashion and may, as a result of impact, impose on the mast considerable bending loads resulting in irreversible deformation modifying the position of the magnetic core within the metal enclosure to the detriment of the insulation distances.

It is known to combat this disadvantage by placing an insulating cone so as to fasten together the top of the column insulator and the top of the mast. This is prejudicial to the quality of the insulation within the metal enclosure and does not completely eliminate the cantilever loading produced by the magnetic core during transport of the current transformer on its side.

The object of the present invention is to remedy these disadvantages.

SUMMARY OF THE INVENTION

The object of the present invention consists in a chocking device comprising at least one jack which is disposed in the metal enclosure surrounding the active part of the current transformer, between the side wall of the enclosure and the external surface of the toroidal magnetic core of the transformer, and which incorporates a base fixed to the side wall of the enclosure, a jack rod which slides within the base in the direction towards and away from the magnetic core, a plate capping the jack rod and contacting the toroidal magnetic core or being spaced therefrom according to whether the jack is extended or retracted, and actuating means by means of which the jack may be retracted from outside the metal enclosure.

During transportation on its side, the current transformer is turned so that the extended jack or one of the extended jacks is positioned vertically between the transport platform and the magnetic core of the current transformer, which eliminates the cantilever loading.

The jack is or the jacks are with advantage disposed within the metal enclosure at the intersection of two cross-section planes of the toroidal magnetic core, one passing through the axis of the opening thereof and being perpendicular to the mast supporting the toroidal magnetic core and the other passing through the support mast and being perpendicular to the axis of the opening of the toroidal magnetic core.

In a preferred embodiment, the base of a jack is in the form of a bush mounted through the wall of the enclosure. The end of the jack rod opposite the plate slides within the base and is formed with a threaded axial bore. The actuating means comprise two stop screws of different lengths threaded into the base from outside the metal enclosure and screwing into the axial bore in the jack rod. The longer stop screw is used when the jack is extended, its head being held against the bottom of the base by auxiliary screws. The shorter stop screw is used when the jack is retracted. The head of the longer stop screw is formed with a threaded axial bore into which the shorter stop screw may be screwed when not in use to maintain the jack in its retracted position.

Other characteristics and advantages of the invention will emerge from the appended claims and from the following description of an embodiment given by way of example. This description will be given with reference to the drawing.

DESCRIPTION OF THE PREFERRED EMBODIMENT

Figures 1, 2:
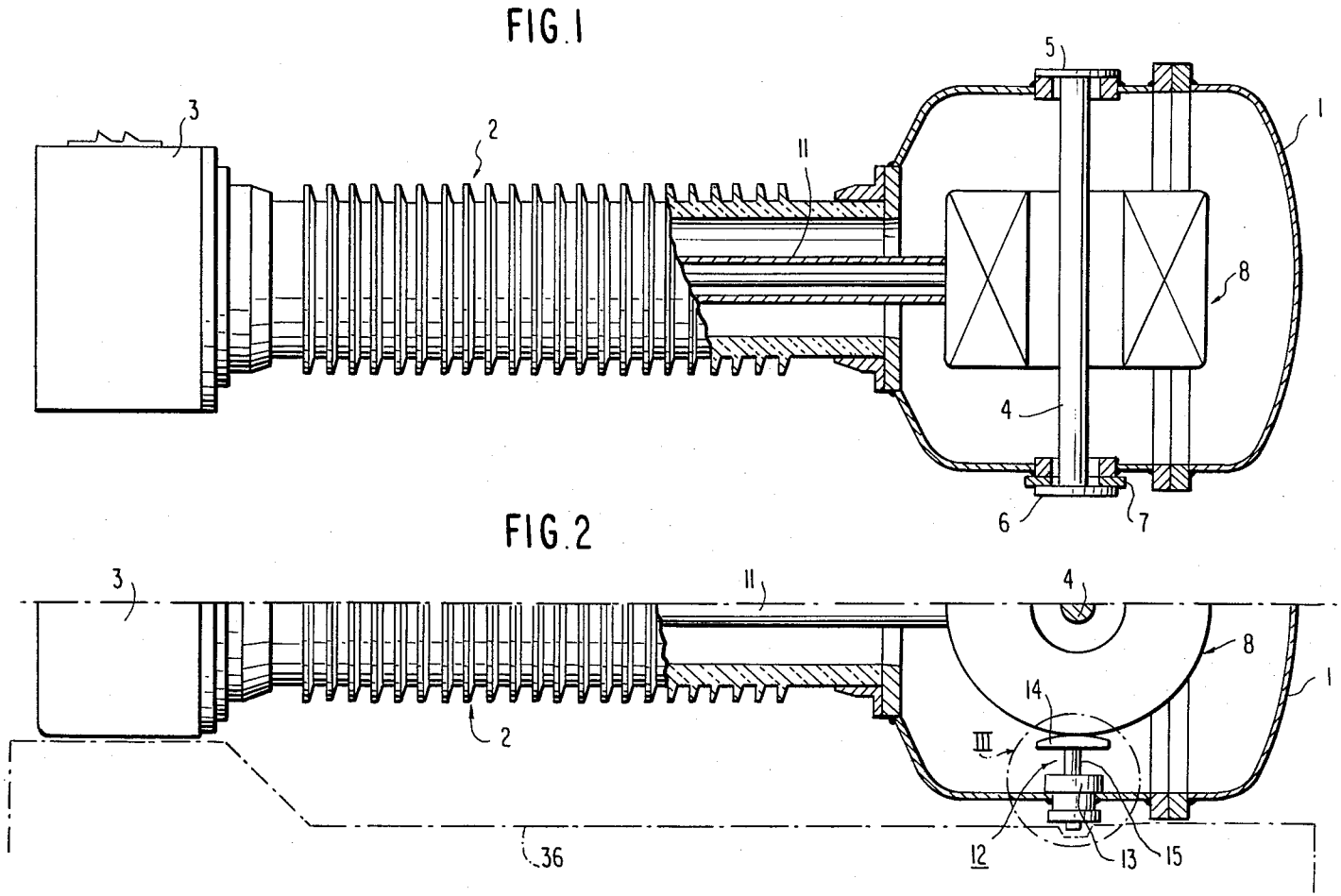
FIG. 1 is a partial longitudinal cross-section through an inverted type current transformer on a plane passing through the axis of the opening of the toroidal magnetic core.
FIG. 2 shows half the current transformer shown in the preceding figure, in partial longitudinal cross-section perpendicular to the axis of the opening of the magnetic core, showing the location of the chocking device in accordance with the invention.

FIGS. 1 and 2 show a typical inverted type current transformer. This comprises an active part disposed in a metal enclosure 1 disposed at the top of a column insulator 2 attached to a metal base 3. The primary of the transformer is a metal rod 4 of high conductivity which may be connected in series with a high-voltage electrical line the current in which is to be measured. This rod 4 extends horizontally across the metal enclosure 1. Its ends are attached in fluid-tight manner to the wall of the metal enclosure 1 by two flanges 5 and 6. One flange 5 is in electrical contact with the wall of the metal enclosure 1 whereas the other flange 6 is electrically isolated therefrom by an insulative washer 7 in order to avoid shunting the current transformer. One or more secondary windings is or are wound around a toroidal magnetic core surrounding the primary conductor rod 4. Their number depends on the application of the current transformer and they are conventionally mounted on the core. The assembly 8 of the magnetic core and the secondary windings is of toroidal shape with an opening axis coincident with the primary conductor rod 4. It is attached to the top of a metal mast 11 disposed in the column insulator 2 and anchored in the base 3. This mast 11 is hollow and provides a conduit for the ends of the secondary windings which are brought out to lead-through electrical terminals (not shown) attached to the base 3. The internal volume of the metal enclosure 1 and the column insulator 2 is hermetically sealed and filled with a dielectric gas providing the insulation between the metal enclosure 1 and the primary rod 4 which are at a high potential, on the one hand, and the metal mast 11 and the assembly 8 of the secondary windings and the core, on the other hand.

The higher the primary voltage the greater the insulation distances to be observed, the increase of the air insulation distance necessitating enlargement of the column insulator 2 and consequently the support mast 11 and the increase in the dielectric gas insulation distance necessitating enlargement of the central opening in the torus formed by the assembly 8 of the secondary windings and the core and consequently enlargement of the cross-section and therefore the mass of the core.

At voltages of the order of 345 kV inverted type current transformers are of great height and comprise magnetic cores weighing several hundred kilograms attached to the top of a mast several meters high which cannot be transported in the vertical position and which is difficult to transport on its side as a result of cantilever loading by the magnetic core.

To avoid such cantilever loading the current transformer is equipped with a chocking device shown within the encircled part III of FIG. 2 and comprising a jack 12 with a base 13 mounted through the wall of the metal enclosure 1 and a plate 14 which is mounted inside the metal enclosure 1 on a rod 15 sliding in the base 13 and facing the external surface of the toroidal assembly 8 formed by the magnetic core and the secondary windings of the current transformer. The jack 12 is disposed at the intersection of two cross-section planes of the magnetic core, one passing through the axis of the opening thereof and being perpendicular to the mast 11 and the other passing through the axis of the mast 11 and being perpendicular to the axis of the opening of the magnetic core. During transport the current transformer is laid on its side, as shown in FIGS. 1 and 2, so that the jack 12 lies in a vertical position between the transport platform 36 and the bottom of the toroidal assembly 8 formed by the magnetic core and the secondaries of the current transformer. To ensure better immobilisation of the latter, the chocking device may comprise a second jack in the diametrically opposed position. It may also include three or four jacks distributed around the perimeter of the metal enclosure 1.

Figure 4:
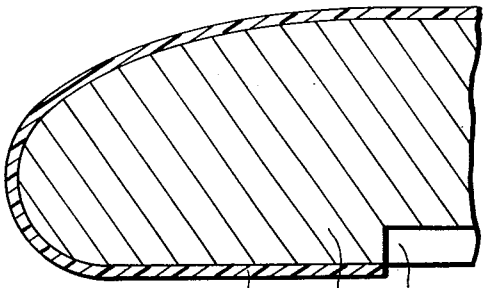
FIG. 4 is an enlarged view of the encircled area IV in FIG. 3 showing details of the shape of the plate capping the jack rod.
Figure 5:
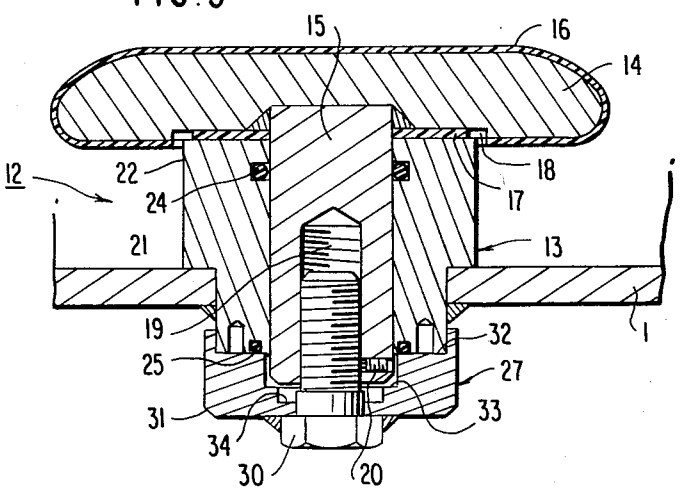
FIG. 5 is a cross-section analogous to that in FIG. 3, showing the jack in the retracted position.
Figure 3:
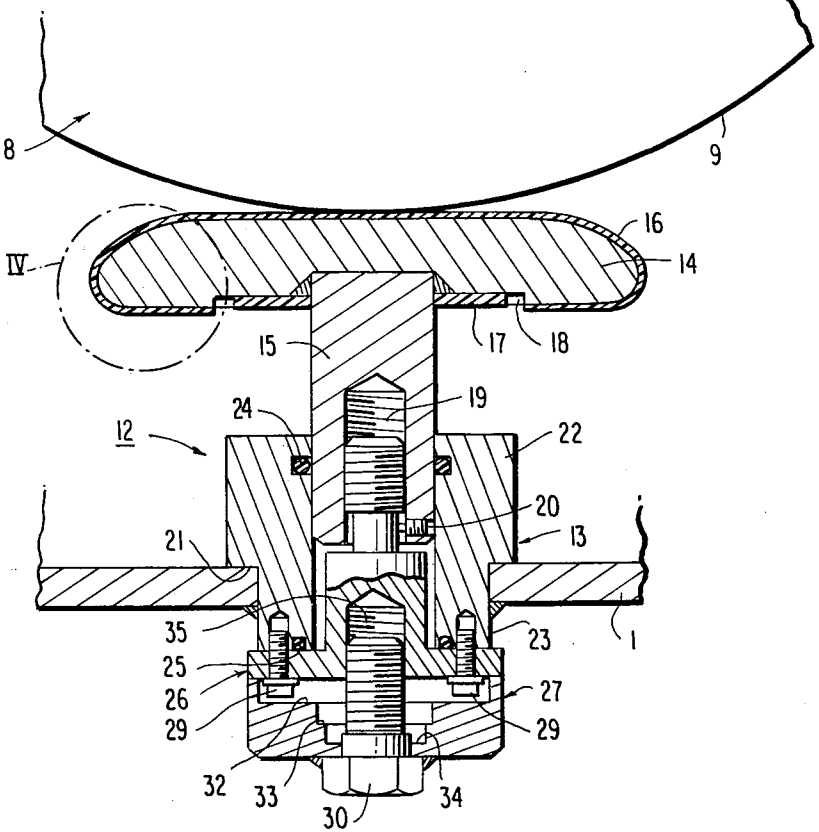
FIG. 3 is an enlarged view of the encircled area III in FIG. 2 showing in detail the parts of the jack of the chocking device in the extended position.

FIGS. 3 to 5 show the construction of the jack 12 in more detail.

The plate 14 of the jack 12 is of metal with rounded edges. It is covered with a coating 16 of polyamide which gives its surface the necessary flexibility to avoid damage to the external surface of the toroidal assembly 8 comprising the magnetic core and the secondary windings of the current transformer. Its bottom surface is welded to the end of the rod 15 which slides in the base 13 of the jack 12.

The rod 15 of the jack 12 is cylindrical. Its free end slides in the base 13 and is formed with a threaded axial bore 19. The rim of this bore 19 is formed with a small diameter threaded hole for a grubscrew 20.

The base 13 of the jack 12 is in the form of a bush through which extends a bore matching the diameter of the rod 15. This bush has in its central part an external shoulder 21 between its front end 22 facing the lower surface of the plate 14 attached to the rod 15 and its rear end 23 which is of smaller external diameter. Its rear end 23 is threaded through a hole of the same size in the side wall of the metal enclosure 1 from inside the metal enclosure 1. Its external shoulder 21 butts up against this wall, to which it is welded in fluid-tight manner.

The rod 15 of the jack 12 is attached to the base 13, in the extended or retracted position, by means of stop screws 26 and 27, of appropriate lengths, which are screwed into the central bore in the base 13 from the rear end 23 of the latter, from outside the metal enclosure 1, screwing in to the axial bore 19 in the free end of the rod 15.

The longer of the stop screws, stop screw 26, is designed to maintain the jack 12 extended, with the rod 15 deployed from the base 13. It is locked onto the rod 15 of the jack by means of the grubscrew 20. Its head, which is wider than the rear end 23 of the base 13, is bolted to the latter by auxiliary screws 29 distributed around its periphery and has a threaded axial bore 35 of the same diameter as the bore 19 in the rod 15 into which the shorter stop screw 27 may be screwed.

The shorter of the stop screws, stop screw 27, is designed to maintain the jack 12 retracted. It is formed by a hexagonal head screw 30 welded in fluid-tight manner to a disc 31 wider than the rear end 23 of the base 13 and formed with a number of concentric and staggered annular grooves facing the end of the screw 30. The largest groove 32 has the same diameter as the rear end 23 of the base 13 and engages over the latter so as to centre the head of the screw 30 relative to the base 13. Its depth is greater than the thickness of the heads of the auxiliary screws 29 so as to be able to cap these when the stop screw 27 is mounted on the head of the stop screw 26. The intermediate groove 33 is deeper than the previous groove and of the same diameter as the free end of the rod 15 of the jack 12 which may project slightly from the rear end 23 so as to expose the grubscrew 20 and permit it to be mounted. The central groove 34 is deeper than the previous two grooves and exposes the start of the thread on the stop screw 27.

An O-ring seal 24 providing temporary sealing during operation of the jack is disposed between the base 13 and the rod 15 of the jack in an annular groove formed in the central bore in the base 13 in the vicinity of its front end. Another O-ring seal 25 providing final sealing of the jack when not being operated is disposed between the rear end of the base 13 and the head of the stop screw 26 or 27 facing same, in an annular groove formed on the rear end 23 of the base 13.

A gasket seal 17 threaded over the rod 15 of the jack and lodged in an annular groove 18 of the same dimensions in the lower face of the plate 14 around the rod 15 engages the front end 22 of the base 13 of the jack and increases the friction force between the plate 14 and the base 13 of the jack to permit loosening of the stop screw 27 when the jack is to be extended from its retracted position.

When the current transformer is being constructed, the entire jack 12 with the exception of the stop screws is inserted from inside the metal enclosure 1 into the opening in the wall designed to accommodate it. The shorter stop screw 27 is engaged on the rear end 23 of the base 13 from outside the metal enclosure 1 and maintains the jack in the retracted position until in-plant tests have been completed. It is then removed and replaced for transportation purposes by the longer stop screw 26. To achieve this, the plate 14 of the jack is brought into contact with the assembly 8 formed by the magnetic core and the secondary windings of the current transformer. The longer stop screw 26 is screwed into the rod 15 of the jack until its head comes into contact with the rear end 29 of the base 13 of the jack. The assembly comprising the plate 14 and the stop screw 26 is withdrawn towards the outside of the enclosure 1 to render the grubscrew 20 accessible. The latter is then tightened and the assembly comprising the plate 14 and the grubscrew 26 pushed back towards the inside of the enclosure. The head of the stop screw 26 is bolted to the base 13 of the jack by means of the auxiliary screws 29, the effect of which is to prestress the assembly 8 comprising the magnetic core and the secondary windings. The shorter stop screw 27 is then screwed on over the top to serve as a cover for the auxiliary screws 29. After the current transformer has been transported on its side as shown in FIG. 2 and returned to the vertical position on its operating site, the jack is retracted by removing the two stop screws 26 and 27 and replacing only the shorter stop screw 27. Note that the jack is operated from outside the metal enclosure 1 of the current transformer, without affecting the sealing thereof, so that the metal enclosure 1 may be filled with dielectric gas at the manufacturing plant without requiring topping up on site.

Certain arrangements may be modified and certain means may be replaced by equivalent means without departing from the scope of the invention.

I claim:

1. A device for chocking an inverted type current transformer when laid on its side, said transformer comprising:

a column insulator (2) having a base (3), a metal enclosure (1) having a sidewall, said metal enclosure (1) being disposed at the top of said column insulator (2), an active part disposed in said metal enclosure (1), said active part having a magnetic core (8) attached to said base (3) of the column insulator (2) by means of a mast (11) disposed within the column insulator (2), said device comprising:

at least one jack disposed in said metal enclosure (1) between said sidewall thereof and an external surface of the toroidal magnetic core (8), said at least one jack having a jack base (13) fixed to said sidewall of said metal enclosure (1) and having a bore extending in the direction towards said toroidal magnetic core (8), said at least one jack further comprising a jack rod (15) sliding within the bore of said jack base (13), said jack rod (15) including a threaded axial bore (19), two stop screws (26, 27) of different lengths for selective projection into said jack base (13) bore from outside the metal enclosure (1) and for screwing into the threaded axial bore (13) in said jack rod (15), the longer stop screw (26) when the jack is extended, the shorter stop screw (27) when the jack is retracted, with the head of the longer stop screw (26) being formed with a threaded axial bore (35), and wherein the shorter stop screw (27) is screwed into said threaded axial bore (35) when not used to maintain said jack in its retracted position, and holding means for holding the head of the longer stop screw (26) against the bottom of the jack base (13) when the jack is extended.

2. A device according to claim 1, wherein the holding means comprise auxiliary screws (29) penetrating bores adjacent the periphery of the head of the longer stop screw (26) and screwed into the bottom of said jack base (13).

3. A device according to claim 2, wherein said jack base (13) includes a cylindrical portion projecting externally of said enclosure sidewall, and herein the shorter stop screw (27) is provided with an annular groove (32) under its head of the same diameter as the portion of said jack base (13) projecting externally of said metal enclosure sidewall whose depth is greater than the thickness of the head of the auxiliary screws (29) so as to receive the same when the short stop screw (27) is threaded to said longer stop screw (26), and wherein said longer stop screw (26) is threadably removed from said jack rod (15), and said short stop screw (27) is threaded thereto, said annular groove (32) receives projecting end of said jack base (13).

4. A device according to claim 1, wherein said jack 12 is disposed at the intersection of two cross-section planes of the toroidal magnetic core (8), one passing through the axis of the opening thereof and being perpendicular to the mast (11) and the other passing through the mast (11) and being perpendicular to the axis of the opening of the toroidal magnetic core (8).

5. A device according to claim 1, wherein the plate (14) is of metal, has rounded edges and is covered with a polyamide coating.

* * * * *